United States Patent [19]

Kubota et al.

[11] Patent Number: 4,685,431

[45] Date of Patent: Aug. 11, 1987

[54] EMERGENCY DEVICE FOR DIESEL ENGINES

[75] Inventors: Kazuhiro Kubota, Hamamatsu; Seiji Kondo, Kakegawa, both of Japan

[73] Assignee: Yamaha, Japan

[21] Appl. No.: 942,066

[22] Filed: Dec. 16, 1986

Related U.S. Application Data

[63] Continuation of Ser. No. 742,196, Jun. 7, 1985, abandoned.

[30] Foreign Application Priority Data

Jun. 9, 1984 [JP] Japan ..... 59-118870

[51] Int. Cl.[4] ..... F02B 77/08

[52] U.S. Cl. ..... 123/198 DB; 123/196 S

[58] Field of Search ..... 123/198 DB, 198 D, 196 S

[56] References Cited

U.S. PATENT DOCUMENTS

| | | | |
|---|---|---|---|
| 2,337,838 | 12/1943 | Reavis | 123/196 S |
| 3,603,300 | 9/1971 | Moffett | 123/196 S |
| 4,020,818 | 5/1977 | Lesnick et al. | 123/196 S |
| 4,102,316 | 7/1978 | Valbert | 123/196 S |
| 4,108,129 | 8/1978 | Roznon | 123/196 S |
| 4,282,838 | 8/1981 | Davidson | 123/196 S |
| 4,450,801 | 5/1984 | Thedens et al. | 123/196 S |
| 4,453,512 | 6/1984 | Sakae et al. | 123/196 S |
| 4,475,498 | 10/1984 | Hurner | 123/196 S |

*Primary Examiner*—Ira S. Lazarus

*Attorney, Agent, or Firm*—Ernest A. Beutler

[57] ABSTRACT

A safety device for a fuel injected diesel engine that shuts off the supply of fuel to the injection nozzles when the lubricant level in the reservoir falls below a predetermined amount. The device includes a control lever that can be latched in a fuel supply position and which is released by a solenoid when the pressure of lubricant in the engine lubricating system falls to indicate a low oil level.

7 Claims, 1 Drawing Figure

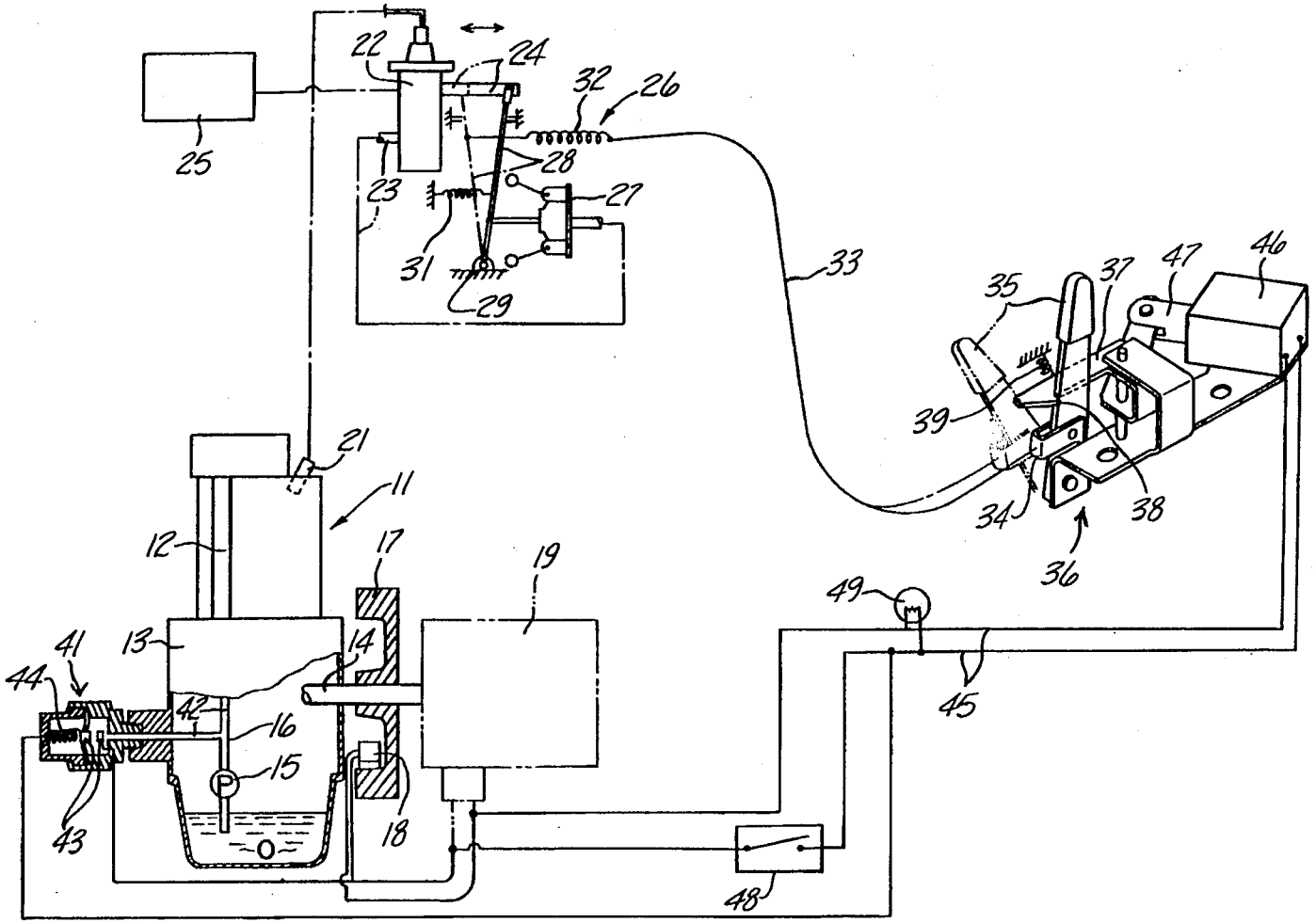
46
47
37
38
36
35
34
39
45
49
33
48
26
32
27
28
24
29
31
19
22
23
18
17
11
14
21
16
15
25
12
42
13
41
43
44

EMERGENCY DEVICE FOR DIESEL ENGINES

BACKGROUND OF THE INVENTION

This invention relates to an emergency device for diesel engines and more particularly to an improved device for preventing damage to the engine if its lubricating oil level falls below a predetermined amount.

In many instances, diesel engines are utilized as stationary power plants and run for long periods of time unattended. For example, a diesel engine may be employed for driving an electrical generator at a preset speed under the control of a governor without requiring operator attention for long periods of time. However, if the quantity of lubricating oil in the engine falls below a safe level, the inattention to the engine can result in major damage. Although warning systems have been proposed to avoid this defect, they are only effective if an operator heeds them and stops the engine or remedies the situation in a timely manner.

It is, therefore, a principal object of this invention to provide an improved emergency device for diesel engines.

It is another object of this invention to provide an improved emergency device that will shut down a diesel engine in the event the level of the lubricating oil is not safe.

SUMMARY OF THE INVENTION

This invention is adapted to be embodied in a protection device for diesel engines having a lubricant system including a reservoir. A fuel injection system is provided for injecting fuel into the engine for its operation and this system includes a control element that is movable between a fuel shutoff position wherein the supply of fuel to the engine is shut off and a fuel control position wherein fuel is supplied to the engine. Holding means are provided which are movable from a running position for holding the control element in the fuel control position for running of the engine and a shutoff position for movement of the control element to its shutoff position for stopping the engine. In accordance with the invention, means are provided that are responsive to the level of lubricant in the reservoir for moving the holding means to its shutoff position when the level in the reservoir falls below a predetermined amount.

BRIEF DESCRIPTION OF THE DRAWINGS

The single FIGURE is a partially schematic view showing a diesel engine, its lubricating system and fuel injection system constructed in accordance with an embodiment of the invention.

DETAILED DESCRIPTION OF THE PREFERRED EMBODIMENT

In the drawings, a diesel engine constructed in accordance with an embodiment of the invention is identified generally by the reference numeral 11. The diesel engine 11 includes a cylinder block 12 having one or more cylinders and which is positioned above a crankcase 13 in which lubricating oil is contained at a level indicated by the line 0. A crankshaft 14 is rotatably journaled in the crankcase 13 in a known manner and drives an oil pump 15 having a discharge conduit 16 for delivering lubricant to the various components of the engine 11 for their lubrication.

The crankshaft 14 drives a flywheel 17 with which a generator 18 is provided for supplying the power necessary for the components of the engine 11 which are electrically activated. In addition, the crankshaft 14 drives an external load 19 which may, for example, comprise an auxiliary generator for providing power for a stationary electrical unit.

The engine 11 is provided with a fuel injection system that includes fuel injection nozzles 21 for each cylinder of the cylinder block 12. The nozzles 21, in the illustrated embodiment, are supported within the cylinder head of the engine and inject directly into the cylinders. Metered fuel is supplied to the nozzles 21 by a fuel injection pump and control unit 22 which may be of any known type. The unit 22 is adapted to time the intervals during which fuel is injected by the nozzles 21 and also to control the amount of fuel injected. For this purpose, the fuel injection control 22 includes a timing cam carried on a camshaft 23 that is driven in timed relationship with the crankshaft 14 in a suitable manner. This cam controls the timing of the fuel injection. In addition, a control rack 24 is supported for reciprocation and controls the amount of fuel discharged. Fuel is supplied to the fuel injection control 22 from a fuel tank 25 in any suitable manner.

The control rack 24 is movable between a first position which is to the extreme left as viewed in the FIG. wherein no fuel will be supplied by the fuel injection control 22 to the nozzles 21. When this condition exists, the engine 11 will be stopped. In addition, the fuel injection control rack 24 may be moved to the right to any of a plurality of positions so as to provide fuel to the nozzles 21 so the engine 11 will run at the desired speed. A governor mechanism, indicated generally by the reference numeral 26, is provided for controlling the position of the rack 24.

The governor 26 includes a governor mechanism 27 that is driven in timed relationship with the camshaft 23 and crankshaft 14 so that its speed of rotation will be related to the engine speed. The governor mechanism 27 is connected to a lever 28 which, in turn, is connected at one end to the fuel control rack 24 so as to adjust the position of the rack depending on the governor condition. The lever 28 is pivotally supported at its other end by means of a pivot pin 29. A return spring 31 acts on the lever 28 so as to urge the lever 28 to the fuel shutoff position.

In order to place the engine in running condition and under the control of the governor mechanism 28, it is necessary to tension a governor spring 32 that acts on the lever 28 in opposition to the return spring 31. The governor spring 32 is tensioned by means of a flexible transmitter 33 that is connected by means of a bracket 34 to a lever 35 of a control mechanism, indicated generally by the reference numeral 36. The lever 35 is pivotally movable between a shutoff position, as shown in the phantom line view, and a running position, as shown in the solid line view. In the shutoff position, the flexible transmitter 33 exerts no tension of the governor spring 32 and the return spring 31 will exert sufficient force on the lever 28 so as to move the fuel control rack 24 fully to the left to its shutoff position. In this condition, as has been noted, there will be no fuel supplied to the injection nozzles 21 and the engine 11 will not run.

When the control lever 35 is moved to the solid line running condition, the governor spring 32 will be tensioned and will exert sufficient force to overcome the action of the return spring 31 and permit the rack 24 to move to a position as set by the governor 27 so as to maintain a uniform running speed for the engine 11.

A locking lever 37 is provided that has a hook end 38 that is adapted to normally engage the lever 35 and hold it in its running position as shown in the FIGURE. The lever 37 is normally held in its engaged running position by means of a coil compression spring 39 that acts on the lever 37 to urge it to this position.

A safety protection device is incorporated for releasing the lever 35 to move to its fuel shutoff position in the event the oil level 0 in the crankcase 13 falls below a predetermined safe level. For this purpose, a pressure responsive switch 41 is provided that has a conduit 42 that communicates with the outlet conduit 16 of the oil pump 15. The switch 41 includes a pair of normally closed contacts 43 that will be urged away from each other against the action of a spring 44 when sufficient oil pressure 42 exists in the line. The contacts 43 are in circuit with a pair of lines 45 that extend to the winding of a solenoid 46 that forms a portion of the operting device 36. The solenoid 46 has its plunger 47 connected to the lever 37 for pivoting the lever 37 toward its released position against the action of the spring 39 when the solenoid 46 is engaged.

The device operates in the following manner. When kthe oil level 0 in the crankcase 13 is sufficient to cover the inlet to the pump 15, there will be sufficient pressure in the lines 16 and 42 so as to hold the contacts 43 open and the solenoid 46 will not be engaged. The control lever 35 may then be held in its running position by the action of the spring 39 and lever 37. If, however, the oil level 0 falls below the predetermined amount, the pump 15 will not generate sufficient output pressure to hold the contacts 43 open and they will close energizing the lines 45 and solenoid 46. Its plunger 47 will then be retracted and the lever 37 will pivot against the action of the spring 39 so as to release the control lever 35. The control lever 35 will then be urged to the left by the action of the return spring 31 as will the control lever 28. The fuel control rack 24 will then be moved to its shutoff position and no fuel will be supplied to the injection nozzles 21 and the engine 11 will stop.

A manuel kill switch 48 may also be provided in the lines 45 for energizing the solenoid 46 and shutting off the engine 11 in the previously described manner, under operator control. In addition, a warning light 49 may be provided across lines 45 so as to be illuminated and provide a visual warning when the engine 11 is stopped. This visual warning may be positioned at a remote location.

It should be readily apparent from the foregoing description that a relatively simple yet highly effective device has been provided for shuting off a diesel engine when the amount of lubricant in its reservoir falls below a predetermined amount. Although an embodiment of the invention hs been illustrated and described, various changes and modifications may be made without departing from the spirit and scope of the invention as defined by the appended claims.

What is claimed is:

1. A protection device for diesel engines driving a generator and having a lubricating system including a reservoir, a fuel injection system for injecting fuel into said engine for its operation, said fuel injection system including a control element movable between a fuel shutoff position wherein the supply of fuel to the engine is shut off and a fuel control position wherein fuel is supplied to the engine, holding means comprising a solenoid operated latch movable from a running position for holding said control element in its fuel control position for running of th engine and a shutoff position upon energization of said solenoid operated latch for movement of said control element to its shutoff position for stopping of the engine, and means responsive to the level of lubricant in said reservoir for energizing said solenoid operated latch from the output of said generator to its shutoff position when the level in said reservoir falls below a predetermined amount.

2. A protection device as set forth in claim 1 wherein the means responsive to the level of lubricant is responsive to the pressure in the engine lubricating system.

3. A protection device as set forth in claim 2 wherein the means responsive to the level of lubricant comprises a normally closed pressure responsive switch.

4. A protection device as set forth in claim 1 wherein there is provided a manual release for the solenoid operated latch.

5. A protection device as set forth in claim 1 further including a warning light for indicating when the solenoid operated latch is released.

6. A protection device as set forth in claim 1 wherein the generator comprises a generator of the engine.

7. A protection device as set forth in claim 1 wherein the generator is an auxiliary generator driven by the engine.

* * * * *